US006966241B2

(12) United States Patent
Huang

(10) Patent No.: US 6,966,241 B2
(45) Date of Patent: Nov. 22, 2005

(54) SELECTIVE ONE-WAY WRENCH

(76) Inventor: Hsiu-Ching Huang, 3F,No. 30,Lane 157,Sec. 3,Hsin Hai Rd.,Da An Dist., Taipei (TW)

( * ) Notice: Subject to any disclaimer, the term of this patent is extended or adjusted under 35 U.S.C. 154(b) by 38 days.

(21) Appl. No.: 10/681,190

(22) Filed: Oct. 9, 2003

(65) Prior Publication Data

US 2005/0044998 A1 Mar. 3, 2005

(30) Foreign Application Priority Data

Aug. 29, 2003 (TW) ..... 92124027 A

(51) Int. Cl.[7] ..... B25B 13/46
(52) U.S. Cl. ..... 81/63.2; 192/43.2
(58) Field of Search ..... 81/60–63.2, 58.4; 192/43.1, 43.2

(56) References Cited

U.S. PATENT DOCUMENTS 6,260,448 B1 * 7/2001 Chaconas ..... 81/63
6,282,993 B1 * 9/2001 Forman et al. ..... 81/63.2
6,382,052 B1 * 5/2002 Chen ..... 81/63
6,386,072 B1 * 5/2002 Yuan-Chin et al. ..... 81/63.2
6,568,299 B2 * 5/2003 Hu ..... 81/63.2
2002/0162424 A1 * 11/2002 Hu ..... 81/60
2003/0177872 A1 * 9/2003 Shu-Ying et al. ..... 81/63.2

* cited by examiner

*Primary Examiner*—Hadi Shakeri
(74) *Attorney, Agent, or Firm*—Charles E. Baxley

(57) ABSTRACT

A selective one-way wrench includes a head, a spring-biased detent, a pawl, a gear, a transmission element and a switch. The head defines a circular space with a reduced open end, a crescent space communicating with the circular space and a hole communicating with the crescent space. The transmission element includes a protrusion formed on a lower face thereof and a cutout. The transmission element is located in the circular space while the cutout is exposed to the exterior through the reduced open end of the circular space. The spring-biased detent is located in the hole. The pawl includes a plurality of teeth, a groove and a recess. The gear is located in the circular space and the teeth engage the pawl.

19 Claims, 12 Drawing Sheets

SELECTIVE ONE-WAY WRENCH

This Nonprovisional application claims priority under 35 U.S.C. §119(a) on Patent Application No(s). 092124027 filed in Taiwan on Aug. 29, 2003, the entire contents of which are hereby incorporated by reference.

FIELD OF INVENTION

The present invention relates to a selective one-way wrench.

BACKGROUND OF INVENTION

Referring to FIG. 12, a conventional selective one-way wrench 80 includes a head 81, a gear 86, a pawl assembly 87 and a switch 90. The head 81 defines a circular space 82, a crescent space 83 communicated with the circular space 82 and a circular cavity 84 communicated with the crescent space 83 and defined in an upper face thereof. The pawl assembly 87 includes two pawls 87 connected with each other by means of a spring 88. Each of the pawls 87 includes a rod 89 extending from an upper face thereof. The pawl assembly 87 is movably put in the crescent space 83. The rods 89 extend from the crescent space 83 into the circular cavity 84. The gear 86 is rotationally put in the circular space 82 for engagement with selective one of the pawls 87 at a time. The switch 90 includes a recess 91 defined in a lower face thereof. The recess 91 includes two ends. The switch 90 is rotationally put in the circular cavity 84 between two positions. Selective one of the rods 89 is put in one of the ends of the recess 91. Thus, the head 81 can drive the gear 86 in selective one of two directions by means of the pawl assembly 87. To retain the switch 91 in selective one of the positions, a spring-biased detent 96 is provided between the bottom of the circular cavity 84 and the lower face of the switch 90. The selective one-way wrench 80 is however weak for including the crescent apace 83 and the circular cavity 84. The selective one-way wrench 80 is complicated because the pawl assembly 87 includes two pawls 88 and a spring 89. The use of the spring-biased detent 96 adds to the complicacy of the elective one-way wrench 80. Moreover, it is difficult to install the pawl assembly 87 and the spring-biased detent 96.

The present invention is therefore intended to obviate or at least alleviate the problems encountered in prior art.

SUMMARY OF INVENTION

It is an objective of the present invention to provide a robust selective one-way wrench.

It is another objective of the present invention to provide a simple selective one-way wrench.

According to the present invention, a selective one-way wrench includes a head, a spring-biased detent, a pawl, a gear, a transmission element and a switch. The head defines a circular space with a reduced open end, a crescent space communicated with the circular space and a hole communicated with the crescent space. The transmission element includes a protrusion formed on a lower face thereof and a cutout defined therein. The transmission element is put in the circular space while the cutout is exposed to the exterior through the reduced open end of the circular space. The spring-biased detent is put in the hole. The pawl includes a plurality of teeth formed on a first side thereof, a groove defined in an opposite second side thereof and a recess defined in an upper face thereof near the first side thereof.

The pawl is put in the crescent space so that the spring-biased detent is trapped in selective one of two ends of the groove and that the protrusion is put in the recess. The gear includes a plurality of teeth formed on a periphery thereof. The gear is put in the circular space so that the teeth thereof are engaged with the teeth of the pawl. The switch includes a rod extending from a lower face thereof. The switch is put in the reduced open end of the circular space so that the rod enters the cutout.

Other objects, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
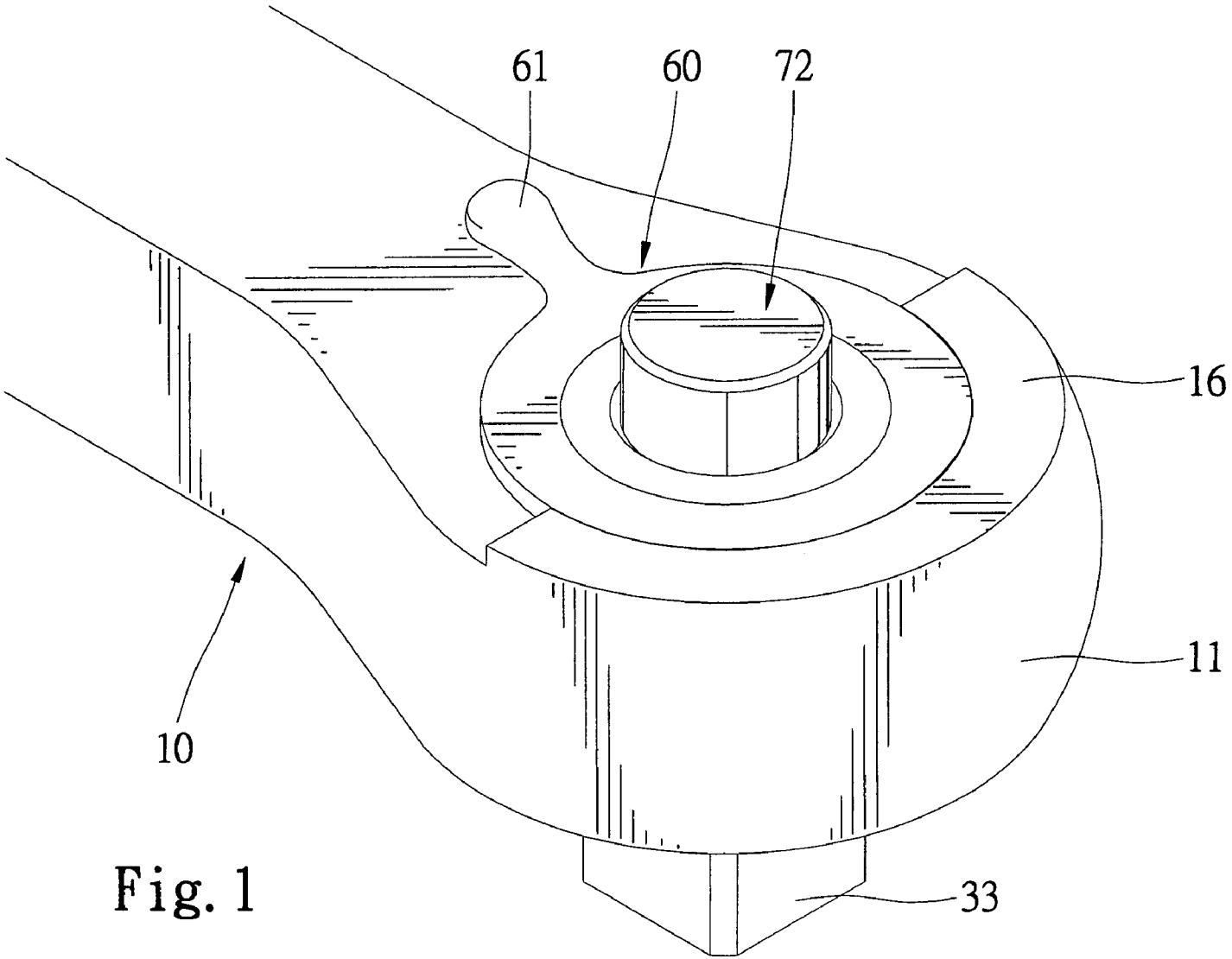
FIG. 1 is a perspective view of a selective one-way wrench according to a first embodiment of the present invention.
Figure 2:
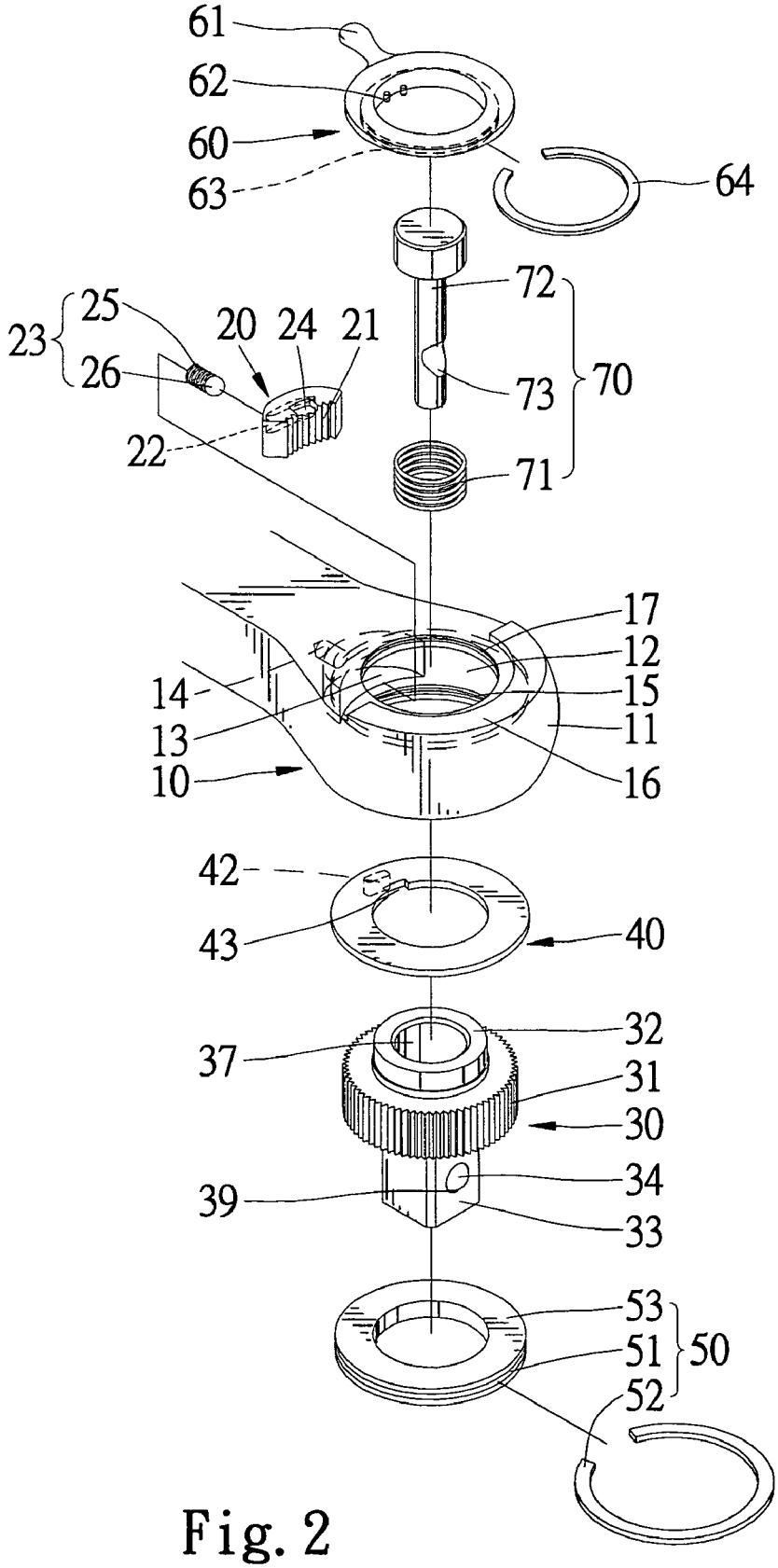
FIG. 2 is an exploded view of the selective one-way wrench shown in FIG. 1.
Figure 3:
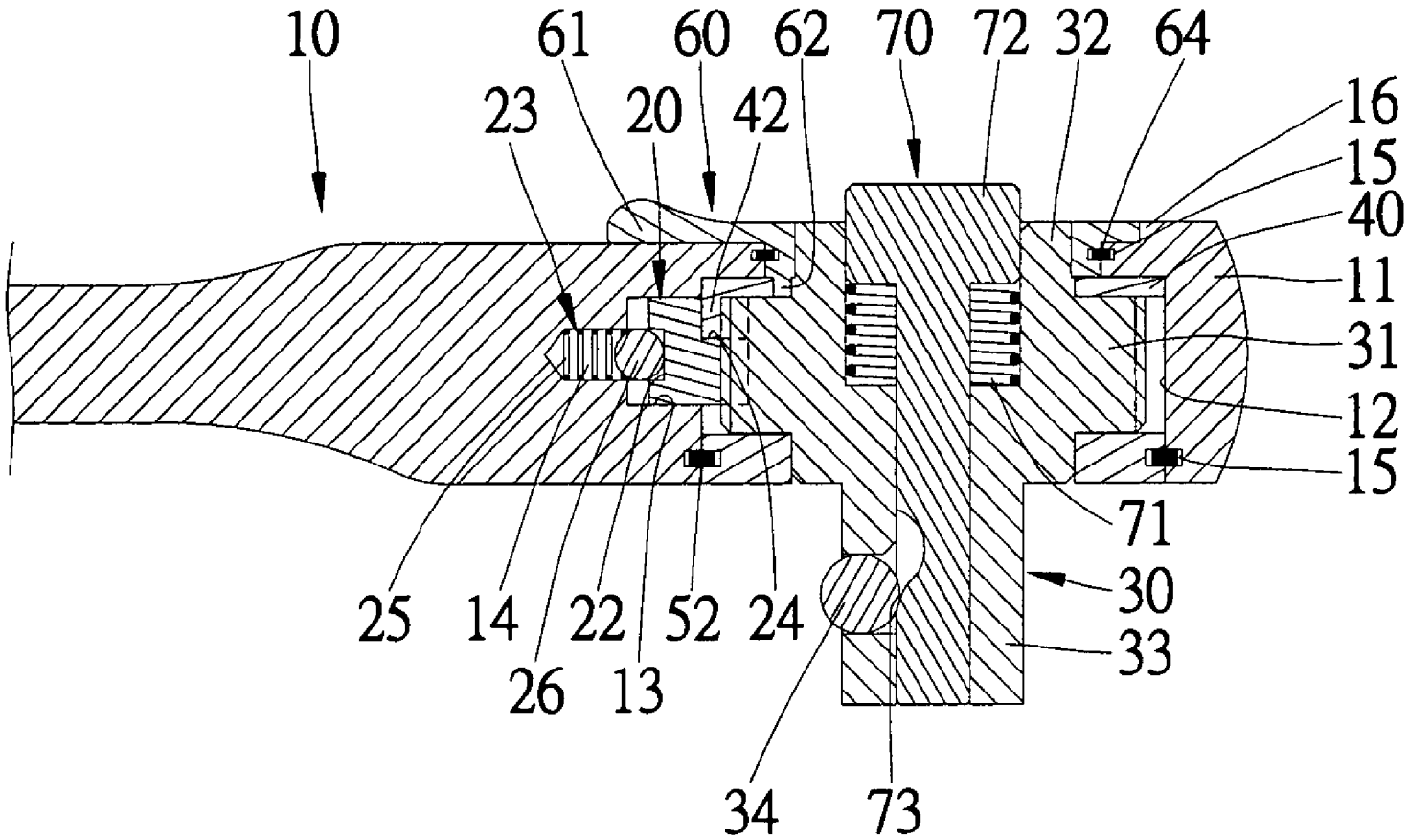
FIG. 3 is a cross-sectional view of the selective one-way wrench of FIG. 1.

Referring to FIGS. 1–3, according to a first embodiment of the present invention, a selective one-way wrench 10 includes a head 11, a spring-biased detent 23, a pawl 20, a gear 30, a transmission element 40, a vertical restraint 50, a switch 60 and a quick-release device 70.

The head 11 defines a circular space 12 with a lower open end and a reduced upper open end, a crescent space 13 communicated with the circular space 12, a hole 14 communicated with the crescent space 13 and two grooves 15 and 17 defined in the wall of the circular space 12. The head 11 includes a limit 16 formed on an upper face thereof. The limit 16 is in the form an arched edge.

The transmission element 40 is in the form of a ring. The transmission element 40 includes a protrusion 42 extending from a lower face thereof near an external edge thereof and a cutout 43 defined in an internal edge thereof. The transmission element 40 is put in the circular space 12. The cutout 43 is exposed to the exterior through the upper open end of the circular space 12.

The spring-biased detent 23 includes a spring 25 and a detent 26. The detent 26 is in the form of a ball. The spring-biased detent 23 is put in the hole 14.

The pawl 20 includes a plurality of teeth 21 formed on a first side thereof, a groove 22 defined in an opposite second side thereof and a recess 24 defined in an upper face thereof near the first side thereof. The groove 22 includes two ends. The second side of the pawl 20 is put in the crescent space 13 while the first side of the pawl 20 is put in the circular space 12. The detent 26 is put in the groove 22. The recess 24 is located in the circular space 12. The protrusion 42 is inserted in the recess 24 so that the transmission element 40 is rotational together with the pawl 20.

The gear 30 includes a plurality of teeth 31 formed on a periphery thereof, a shaft 32 extending from an upper face thereof and an axle 33 extending from a lower face thereof. A pocket 37 is defined in the gear 30. The pocket 37 extends from the shaft 32 to the axle 34. An aperture 39 is defined in the axle 33. The pocket 37 includes a lower section with which the aperture 39 is communicated and an enlarged upper section. A shoulder (not numbered) is formed between the lower and upper sections of the pocket 37. The gear 30 is put in the circular space 12. The teeth 31 can be engaged with the teeth 21.

The vertical restraint 50 includes an O-ring 53 and a C-ring 52. The O-ring 53 includes a groove 51 defined in an external side thereof. The C-ring 52 includes an internal edge put in the groove 51 and an external edge put in the groove 15. Thus, the vertical restraint 50 is secured to the head 11. The gear 30 is supported on the vertical restraint 50 while the axle 33 is inserted through the vertical restraint 50.

The switch 60 is in the form of a ring. The switch 60 includes a lever 61 extending from an external side thereof, two rods 62 extending from a lower face thereof and a groove 63 defined in the external edge thereof. The switch 60 is mounted on the shaft 32. A C-ring 64 includes an internal edge put in the groove 63 and an external edge put in the groove 17. Thus, the switch 60 is attached to the head 11. The rods 62 are inserted in the cutout 43. Pivoting of the lever 61 is limited in a proper range by means of the limit 16.

A detent 34, in the form of a ball, is put in the lower section of the pocket 37 and exposed through the aperture 39.

The quick-release device 70 includes a spring 71 and a latch 72. The latch 72 is in the form of a pin including a lower section, an enlarged upper section and a notch 73 defined in the lower section.

The spring 71 is put in the upper section of the pocket 37. The lower section of the latch 72 is inserted in the lower section of the pocket 37 while the upper section of the latch 72 is put in the upper section of the pocket 37. The spring 71 is compressed between the shoulder of the pocket 37 and the upper section of the latch 72. Normally, the lower section of the latch 72 keeps the detent 34 exposed through the aperture 39. Via pushing the upper section of the latch 72, the lower section of the latch 72 is moved downwards. Thus, the notch 73 receives the detent 34 so that the detent 34 is drawn back into the aperture 39.

Figure 4:
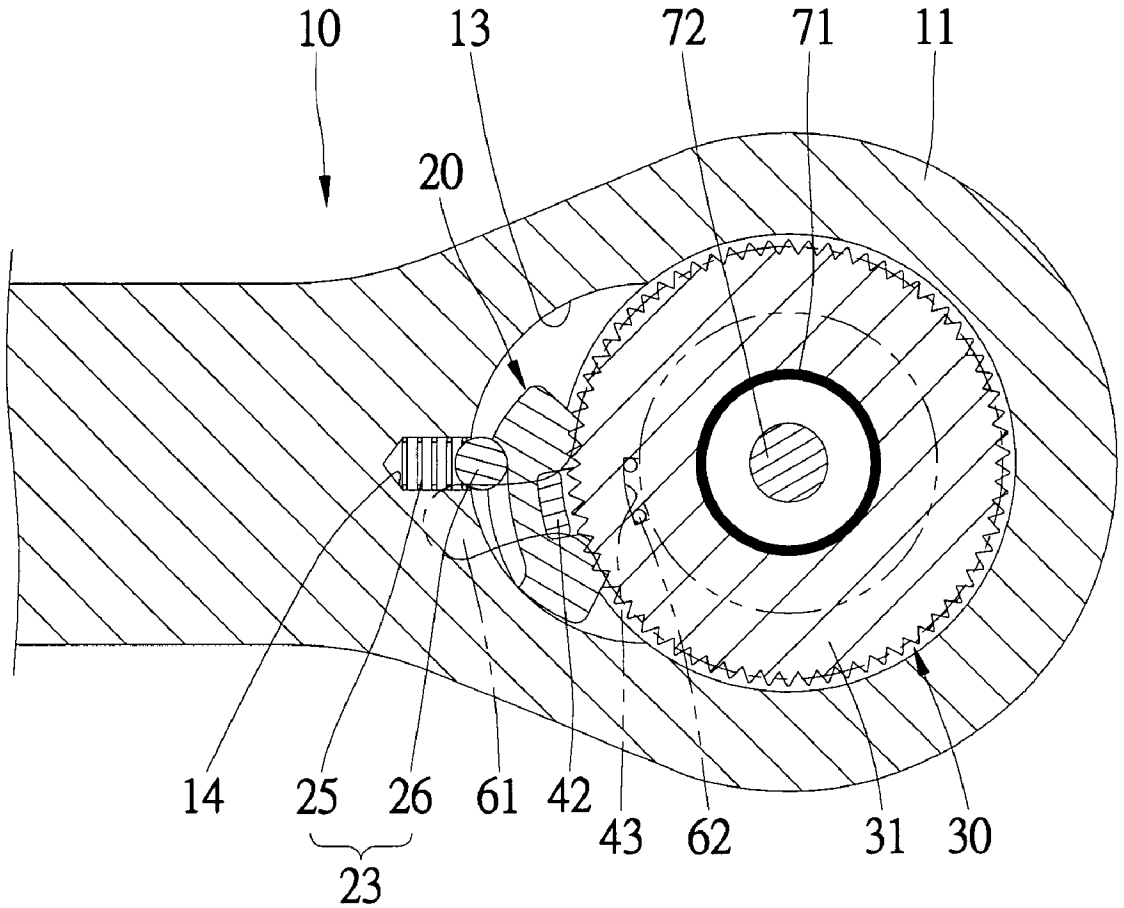
FIGS. 4–6 are cross-sectional views of the selective one-way wrench of FIG. 1 in a clockwise mode.
Figure 5:
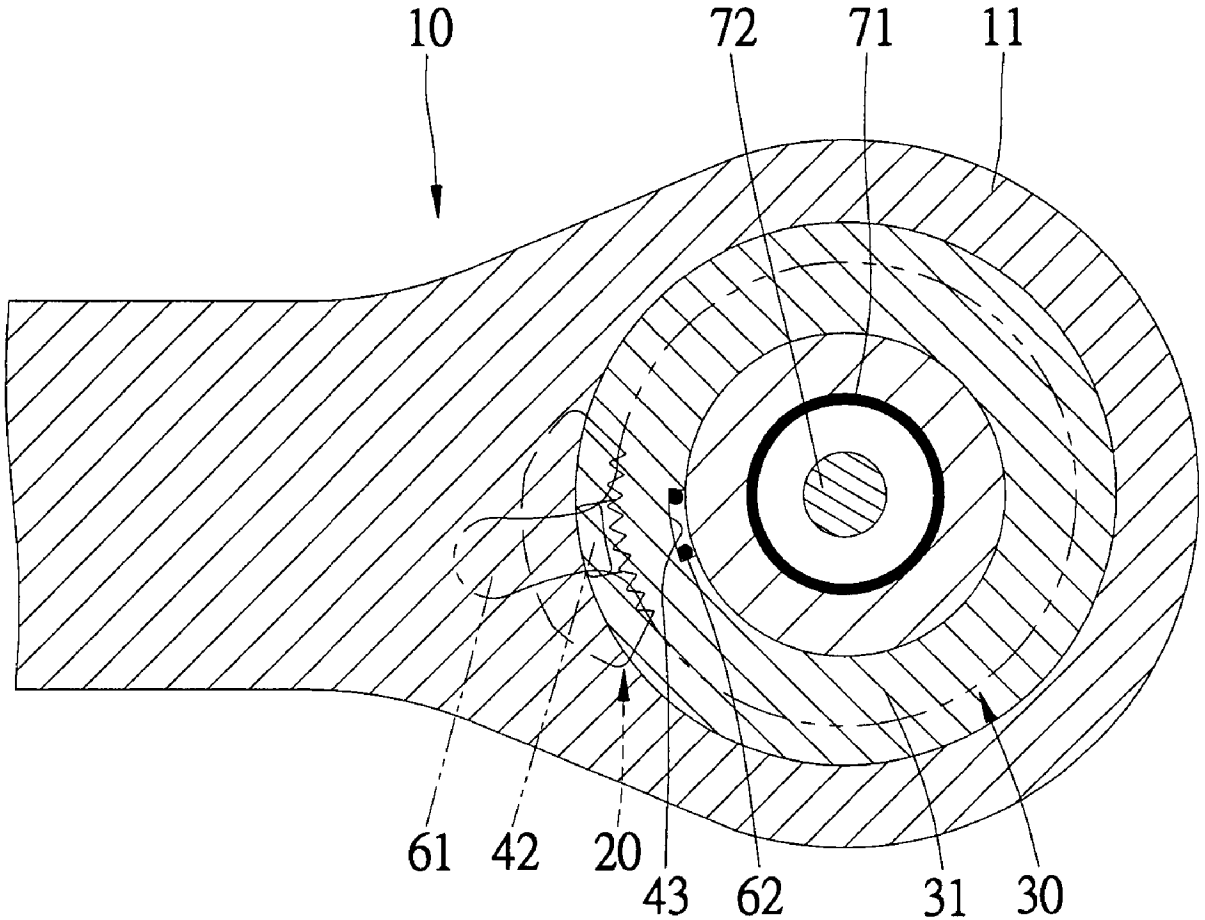
Figure 6:
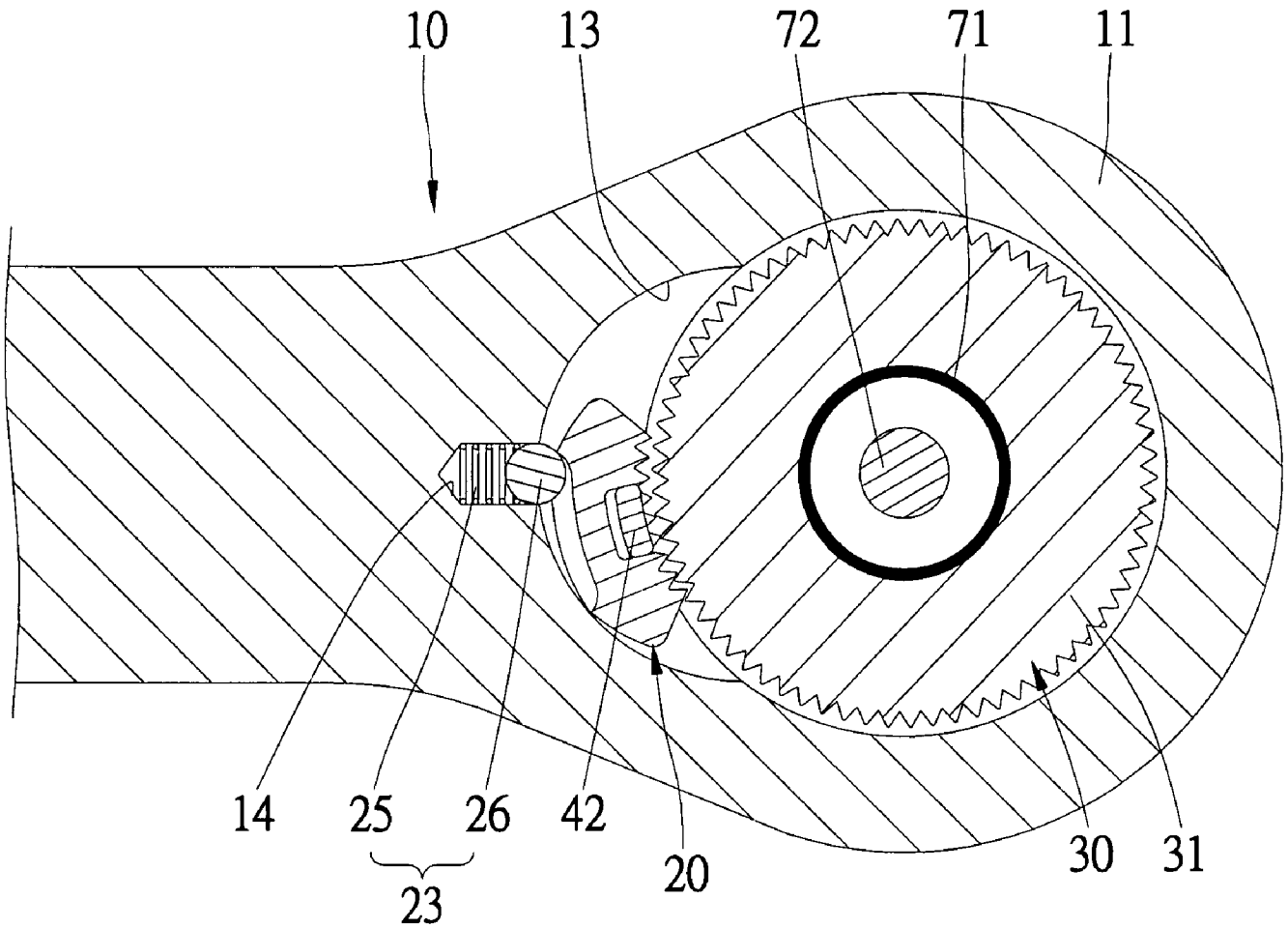

Referring to FIGS. 4–6, the selective one-way wrench 10 is in a clockwise mode. In the clockwise mode, the head 11 can drive the gear 30 clockwise by means of the pawl 20 as best shown in FIG. 4 but not vice versa as shown in FIG. 6. Biased by means of the spring 25, the detent 26 is trapped in an end of the groove 22. Thus, the selective one-way wrench 10 is retained in the clockwise mode.

Figure 7:
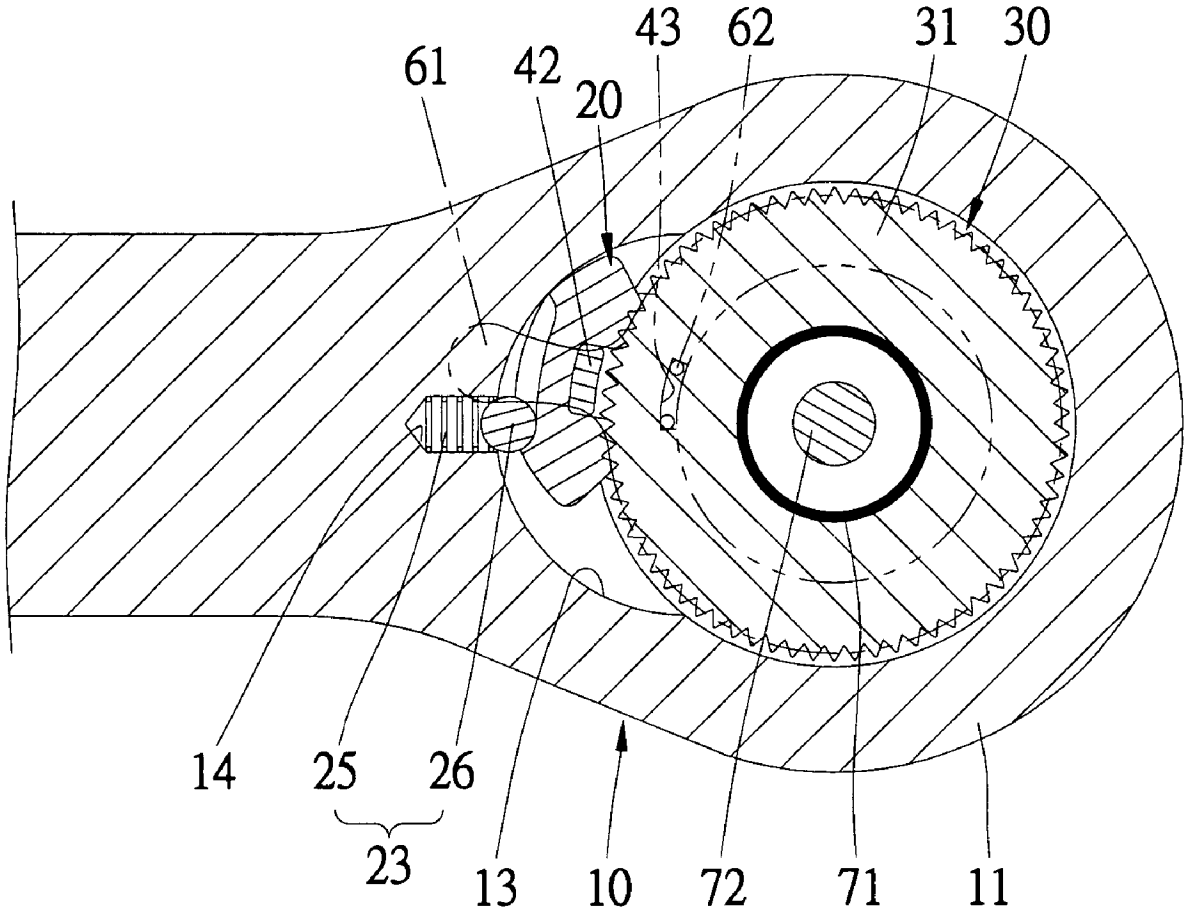
FIGS. 7 and 8 are cross-sectional views of the selective one-way wrench of FIG. 1 in a counterclockwise mode.
Figure 8:
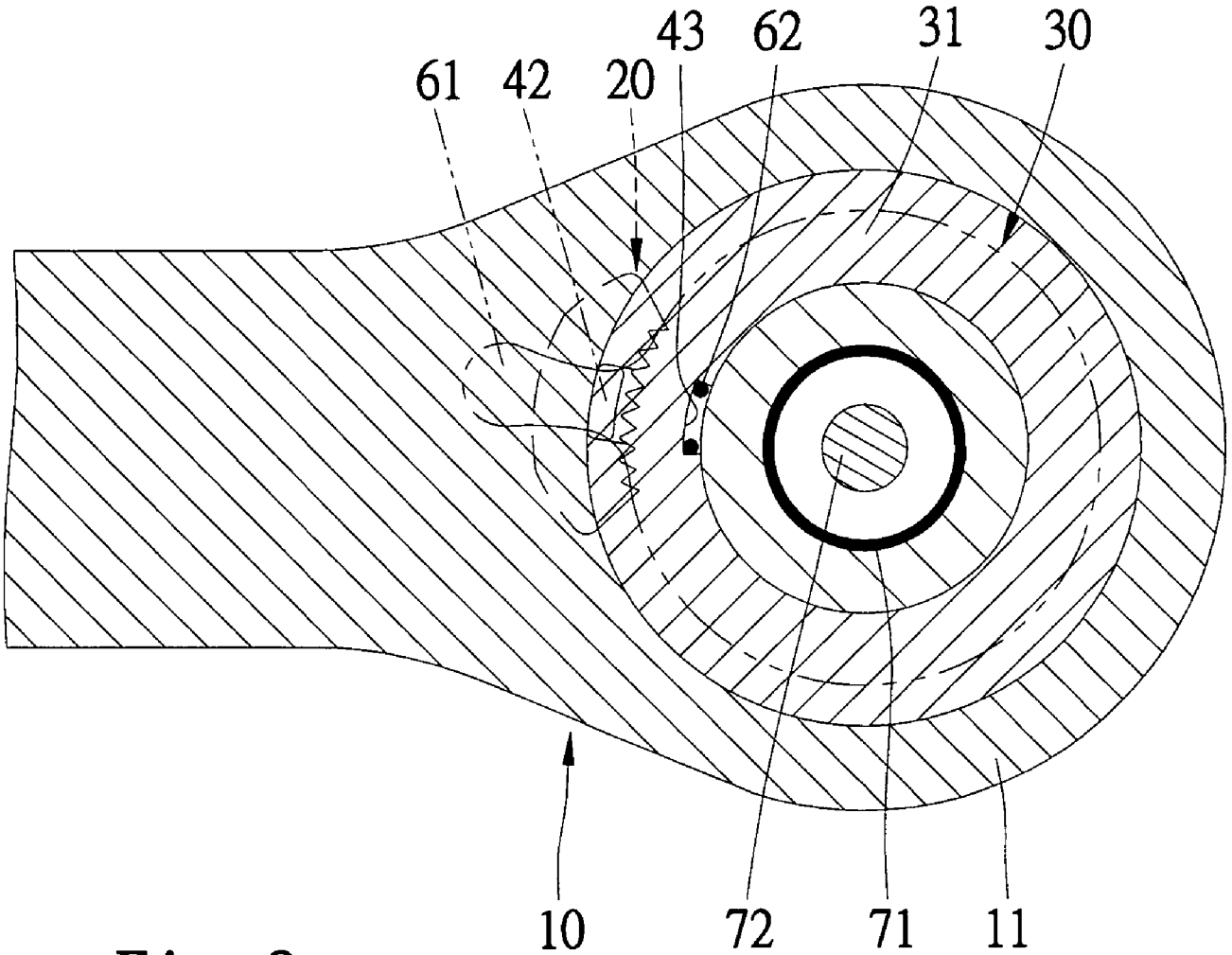

Via operating the lever 61, the selective one-way wrench 10 is moved to a counterclockwise mode shown in FIGS. 7 and 8. As the lever 61 is operated, the switch 60 is rotated. The transmission element 40 is rotated by means of the switch 60 since the cutout 43 traps the rods 62. The pawl 20 is moved by means of the transmission 40 since the recess 24 traps the protrusion 42. In the counterclockwise mode, the head 11 can drive the gear 30 counterclockwise by means of the pawl 20, but not vice versa. Biased by means of the spring 25, the detent 26 is trapped in an end of the groove 22. Thus, the selective one-way wrench 10 is retained in the counterclockwise mode.

Figure 9:
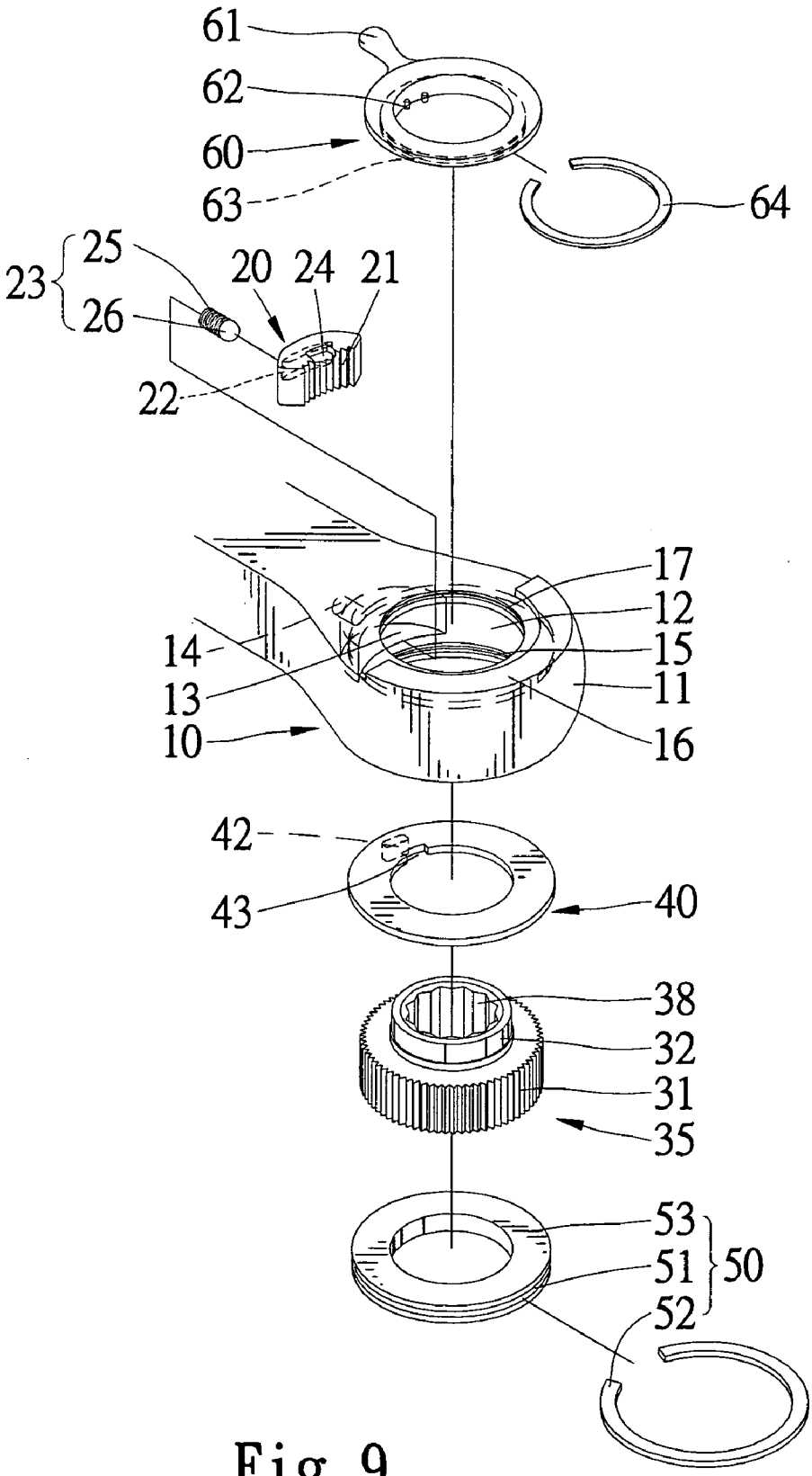
FIG. 9 is an exploded view of a selective one-way wrench according to a second embodiment of the present invention.
Figure 10:
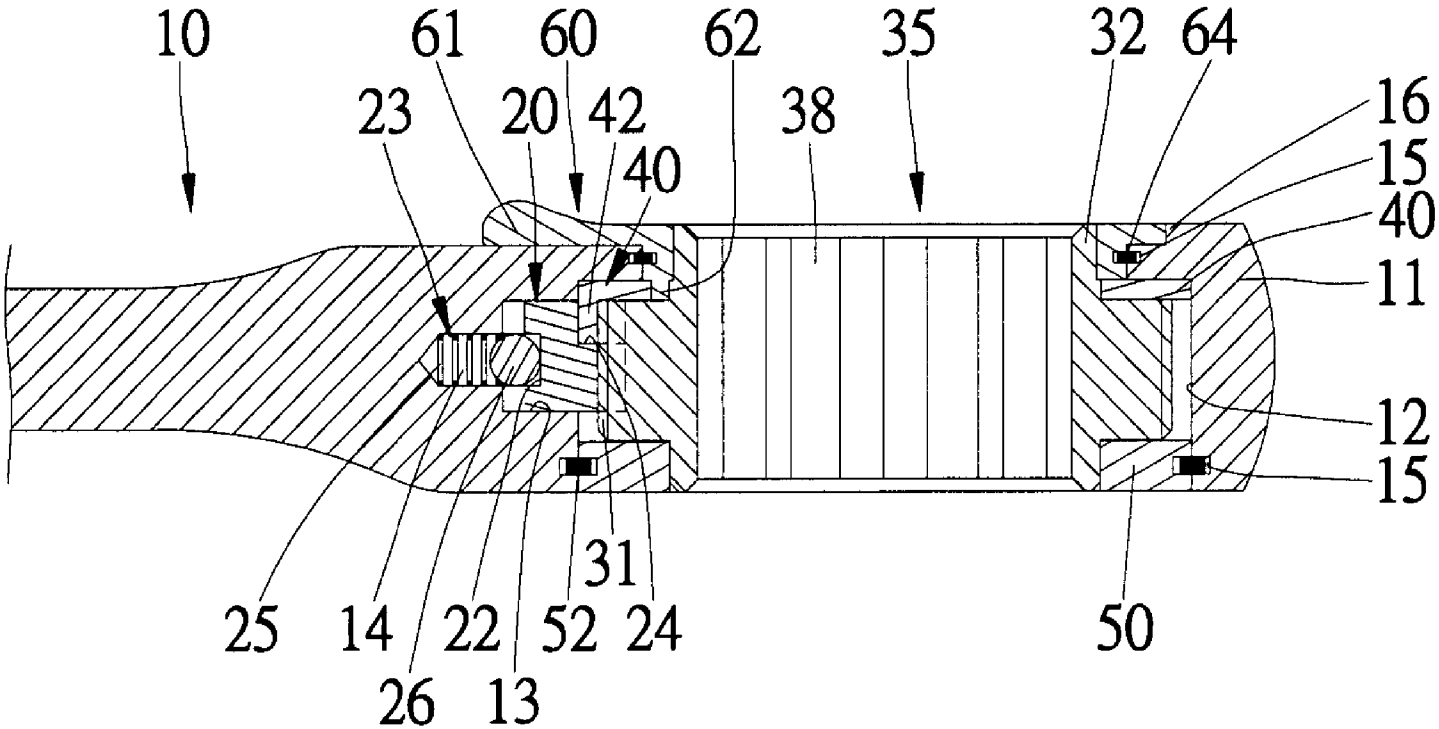
FIG. 10 is a cross-sectional view of the selective one-way wrench of FIG. 9.
Figure 11:
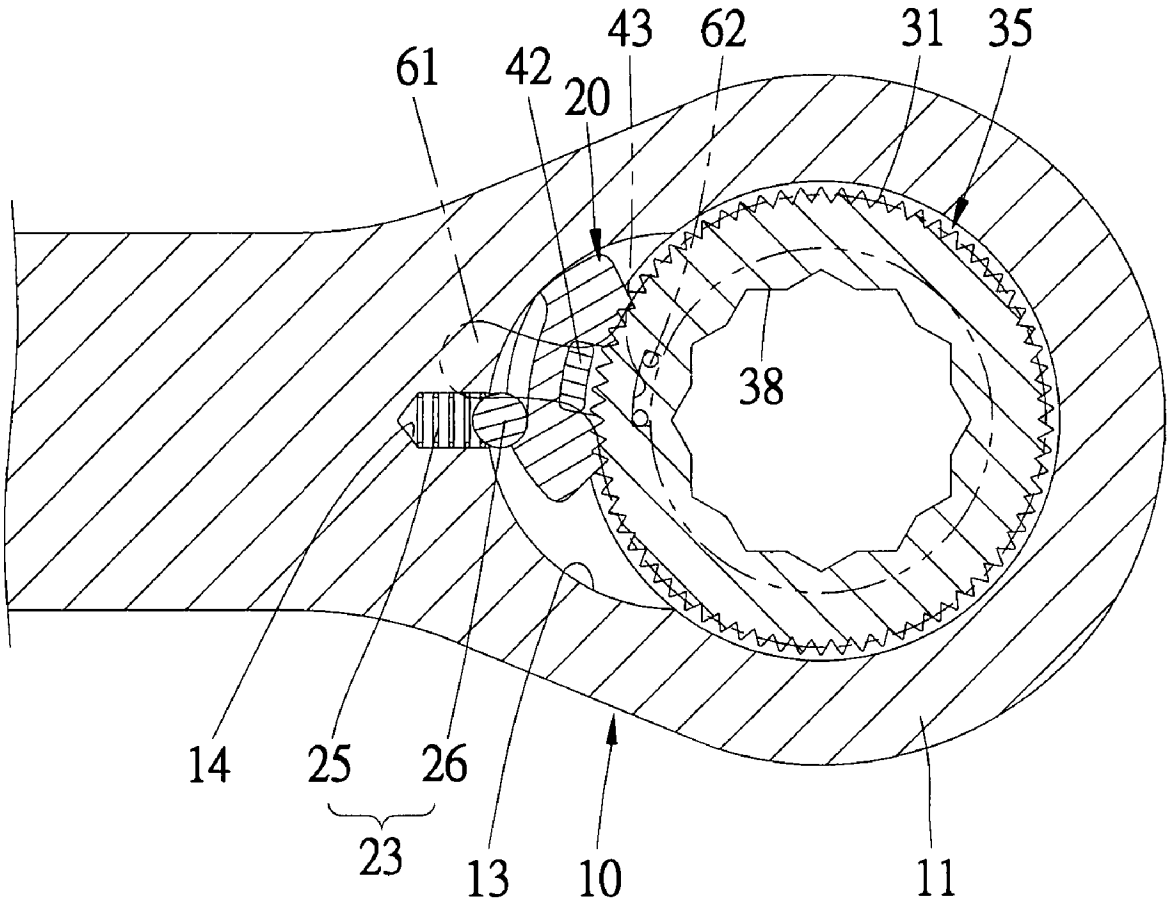
FIG. 11 is a cross-sectional view of the selective one-way wrench of FIG. 9 in a clockwise mode.
Figure 12:
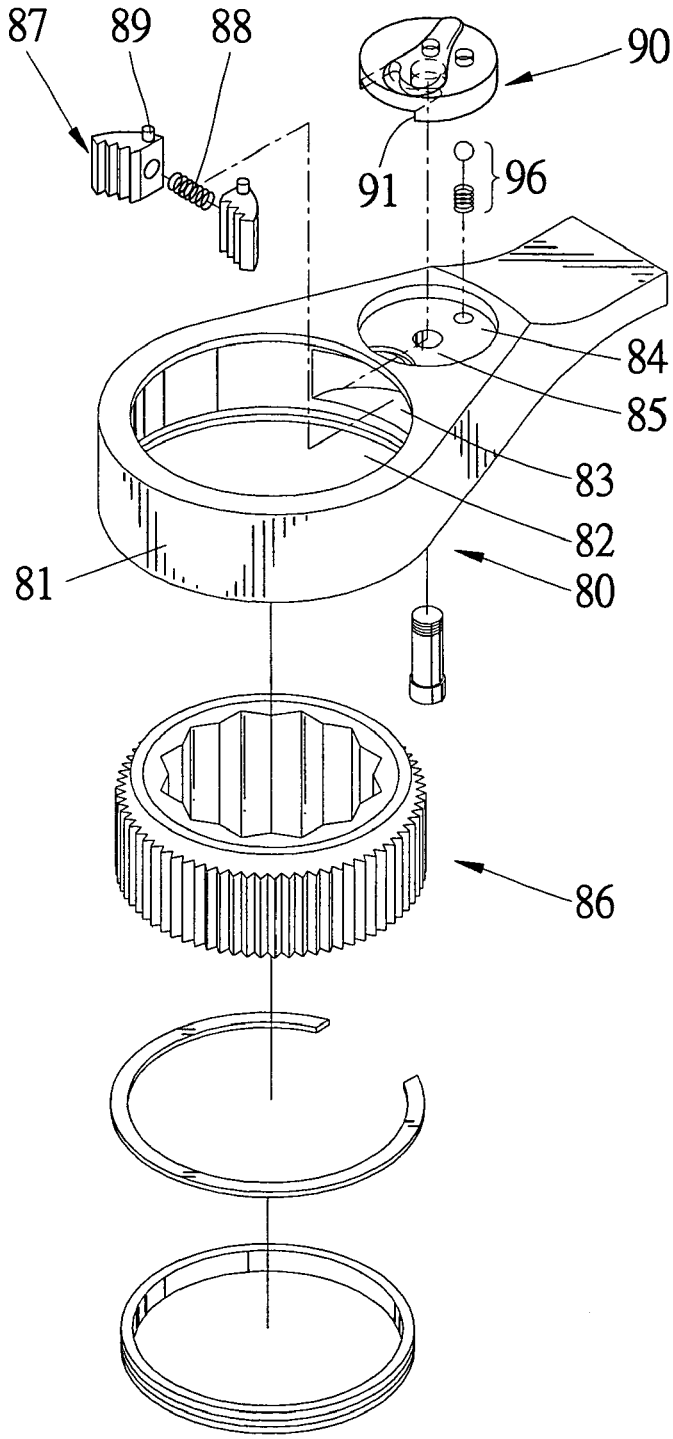
Fig. 12 PRIOR ART
FIG. 12 is an exploded view of a conventional selective one-way wrench.

FIGS. 9–11 show a selective one-way wrench according to a second embodiment of the present invention. The second embodiment is identical to the first embodiment except for using a gear 35 instead of the gear 30. The gear 35 is an annular gear including a plurality of teeth 31 formed on an external side thereof for engagement with the teeth 21 and a plurality of teeth 38 formed on an internal side thereof for engagement with a bolt or nut.

The present invention has been described via detailed illustration of two embodiments. Those skilled in the art can derive variations from the embodiments without departing from the scope of the present invention. Therefore, the embodiments shall not limit the scope of the present invention defined in the claims.

What is claimed is:

1. A selective one-way wrench including:

a head defining a circular space with a reduced open end, a crescent space communicated with the circular space and a hole communicated with the crescent space;

a transmission element including a protrusion formed on a lower face thereof adjacent and facing said crescent space and a cutout defined therein, wherein the transmission element is put in the circular space while the cutout is exposed to the exterior through the reduced open end of the circular space;

a spring-biased detent put in the hole;

a pawl including a plurality of teeth formed on a first side thereof, a groove defined in an opposite second side thereof and a recess defined in an upper face thereof near the first side thereof, wherein the pawl is put in the crescent space so that the spring-biased detent is trapped in selective one of two ends of the groove and that the protrusion is put in the recess;

a gear including a plurality of teeth formed on a periphery thereof, wherein the gear is put in the circular space so that the teeth thereof are engaged with the teeth of the pawl; and a switch including two rods extending from a lower face thereof, wherein the switch is put in the reduced open end of the circular space so that the rods enter the cutout.

2. The selective one-way wrench of claim 1, wherein the switch includes a lever extending from a periphery thereof.

3. The selective one-way wrench of claim 2 wherein the head includes an arched edge limited formed on an upper face thereof for limiting pivotal of the lever within a proper range.

4. The selective one-way wrench of claim 2 wherein the head includes two limits formed on an upper face thereof for limiting pivotal of the lever within a proper range.

5. The selective one-way wrench of claim 1 further including a C-ring wherein the head includes a groove defined in the wall of the circular space for receiving an external edge of the C-ring, and the switch includes a groove defined in a periphery thereof for receiving an internal edge of the C-ring.

6. The selective one-way wrench of claim 1, wherein the gear includes a shaft extending from an upper face thereof, and the transmission element is in the form of a ring into which the shaft extends.

7. The selective one-way wrench of claim 6, wherein the protrusion is near an external edge of the transmission element.

8. The selective one-way wrench of claim 6, wherein the cutout is defined in an internal edge of the transmission element.

9. The selective one-way wrench of claim 6, wherein the switch is in the form of a ring into which the shaft extends.

10. The selective one-way wrench of claim 9, wherein the rods are near an internal edge of the switch.

11. The selective one-way wrench of claim 1 further including a vertical restraint secured to the head for restraining the gear in the circular space.

12. The selective one-way wrench of claim 11 wherein the vertical restraint includes an O-ring secured to the head.

13. The selective one-way wrench of claim 12 wherein the vertical restraint further includes a C-ring for securing the O-ring to the head.

14. The selective one-way wrench of claim 13 wherein the head defines a groove defined in the wall of the circular space for receiving an external edge of the C-ring, and the O-ring includes a groove defined in an external side thereof for receiving an internal edge of the C-ring.

15. The selective one-way wrench of claim 1, wherein the gear is an annular gear.

16. The selective one-way wrench of claim 1, wherein the gear includes an axle extending from a lower face thereof.

17. The selective one-way wrench of claim 16 further including a detent movably attached to the axle.

18. The selective one-way wrench of claim 17, wherein the axle defines an aperture for receiving the detent.

19. The selective one-way wrench of claim 18 further including a quick release device, wherein the gear defines a pocket communicated with the aperture so as to receive the quick-release device.

* * * * *